US009881541B2

(12) United States Patent
Pollok

(10) Patent No.: US 9,881,541 B2
(45) Date of Patent: Jan. 30, 2018

(54) APPARATUS, SYSTEM, AND METHOD FOR VIDEO CREATION, TRANSMISSION AND DISPLAY TO REDUCE LATENCY AND ENHANCE VIDEO QUALITY

(71) Applicant: Douglas Pollok, Austin, TX (US)

(72) Inventor: Douglas Pollok, Austin, TX (US)

( * ) Notice: Subject to any disclaimer, the term of this patent is extended or adjusted under 35 U.S.C. 154(b) by 430 days.

(21) Appl. No.: 14/697,218

(22) Filed: Apr. 27, 2015

(65) Prior Publication Data

US 2015/0310797 A1 Oct. 29, 2015

Related U.S. Application Data

(60) Provisional application No. 61/984,855, filed on Apr. 27, 2014.

(51) Int. Cl.
*G09G 3/20* (2006.01)

(52) U.S. Cl.
CPC ..... *G09G 3/2018* (2013.01); *G09G 2310/04* (2013.01)

(58) Field of Classification Search
CPC ..... G09G 3/2018–3/204; G09G 2310/04
USPC ..... 345/690–697
See application file for complete search history.

(56) References Cited

U.S. PATENT DOCUMENTS

2003/0122773 A1* 7/2003 Washio ..... G09G 3/3648 345/103
2009/0256868 A1* 10/2009 Low ..... G06F 3/0481 345/691
2015/0187277 A1* 7/2015 Maeyama ..... G09G 3/3291 345/694

* cited by examiner

*Primary Examiner* — Michael Pervan
(74) *Attorney, Agent, or Firm* — Hulsey, P.C.

(57) ABSTRACT

Disclosed subject matter provides apparatus, systems and methods for providing video on a video display with refreshing of a plurality of partial display pixel subgroups.

14 Claims, 15 Drawing Sheets

PRIOR ART

PRIOR ART

APPARATUS, SYSTEM, AND METHOD FOR VIDEO CREATION, TRANSMISSION AND DISPLAY TO REDUCE LATENCY AND ENHANCE VIDEO QUALITY

CROSS-REFERENCE TO RELATED APPLICATIONS

This application claims priority to U.S. Provisional Application No. 61/984,855 filed Apr. 27, 2014 and titled "Method of video creation, transmission and display used to reduce latency and enhance video quality," which is hereby incorporated by reference in its entirety.

FIELD OF THE INVENTION

The present disclosure relates to apparatus, systems and methods for creation, transmission and display of video.

BACKGROUND OF THE INVENTION

Video may be defined or understood as a series of images, pictures or frames presented or displayed in sequence over time in order to give the appearance of motion. Video may be created, rendered, transmitted, reconstructed, generated and displayed, stored in a suitable medium, further processed, or otherwise utilized.

BRIEF SUMMARY OF THE INVENTION

Video may be defined or understood as a series of images, pictures or frames displayed in sequence over time in order to give the appearance of motion (hereinafter "video"). It will be understood that, herein and in accordance with the preceding sentence, the "appearance of motion" may be characterized as being "given" or provided so as to be appreciated, experienced, understood or perceived by a viewer, such as a person or subject, who may be considered to be viewing or seeing the displayed series of images, pictures, or frames constituting such video. Video may be created, rendered, transmitted, reconstructed, generated and displayed to a viewer (the preceding, collectively, being referenced hereinafter as "processing" or in other tense, such as "processed"). It will be understood that in connection with processing video, one or more encoders, decoders, codecs, transcoders, algorithms, compressors, de-compressors, or similar apparatus, systems or methods may be utilized. It will be understood that the aforementioned may be embodied, in part or whole, in executable instructions, code or software stored in accessible media, storage or memory, and which may be executable on or in connection with a suitable processor or processing platform; hardware; or suitable combination of the same.

Video latency may be defined, for example, as time required or taken to create, render, transmit, reconstruct, generate and display each image, picture or frame of video. It will be understood that video latency also may be understood or defined as time required or taken to create, render, transmit, reconstruct, generate and display groupings or groups of images, pictures or frames of videos. It will also be understood in accordance with the preceding that video latency may be understood or defined as time required or taken to process each image, picture or frame of video, or to provide groups of images, pictures or frames of such video.

Embodiments of disclosed subject matter provide improved methods for displaying or providing video on a video display. Embodiments of disclosed subject matter provide improved systems for displaying or providing video on a video display. Embodiments of disclosed subject matter provide improved apparatus for displaying or providing video on a video display.

BRIEF DESCRIPTION OF THE DRAWINGS

The novel features believed characteristic of the disclosed subject matter will be set forth in any claims that are filed later. The disclosed subject matter itself, however, as well as a mode of use, further objectives, and advantages thereof, will best be understood by reference to the following detailed description of an illustrative embodiment when read in conjunction with the accompanying drawings.

DETAILED DESCRIPTION OF ILLUSTRATIVE EMBODIMENTS

Reference now should be made to the drawings, in which the same reference numbers are used throughout the different figures to designate the same components.

Figure 1:
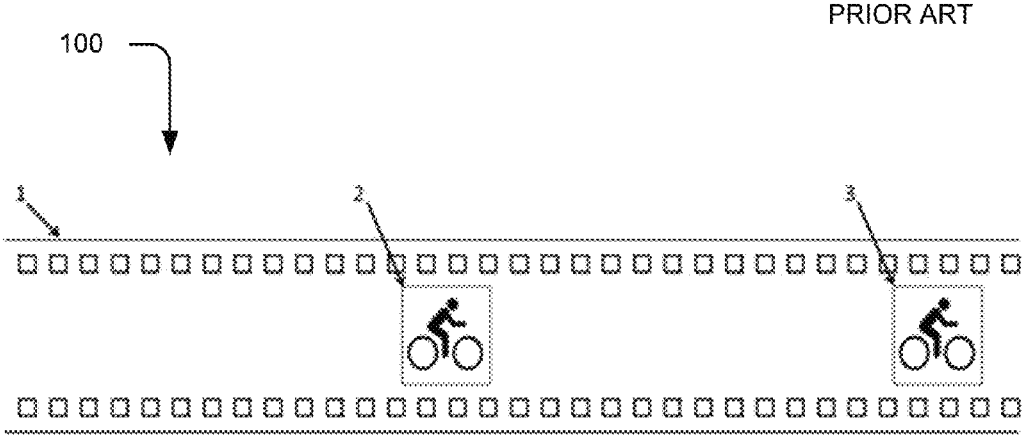
FIG. 1 is a simplified schematic illustration of a method for providing video according to prior art.

FIG. 1 is a simplified schematic illustration of a method for providing video according to prior art. In the specific arrangement illustrated in FIG. 1, a filmstrip 10 has or is characterized by an associated timeline 20 indicating pace or timing of filmstrip 10 and associated events. Filmstrip 10 includes first frame 30 and, in series thereafter, second frame 40. Referring to timeline 20, it may be observed that first frame 30 is processed at 0.02 seconds from time zero, and second frame 40 is processed at 0.04 seconds from time zero. It will be understood in accordance with the preceding, that total time to process filmstrip 10, including both first frame 30 and second frame 40, is 0.04 seconds from time zero.

Figure 2:
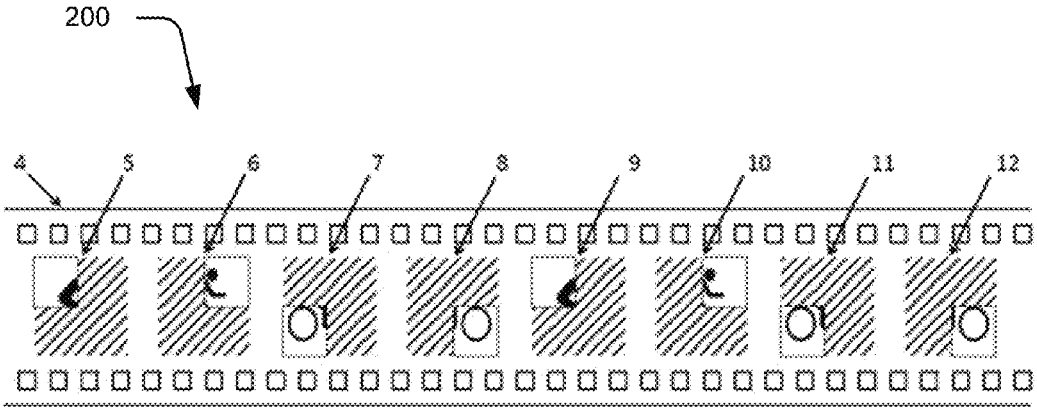
FIG. 2 is a simplified schematic diagram illustrating aspects of a method for providing video on a video display in an exemplary embodiment of disclosed subject matter.

FIG. 2 is a simplified schematic diagram illustrating a method 200 for providing video on a video display in an exemplary embodiment of disclosed subject matter. In the particular arrangement illustrated in FIG. 2, the video is a filmstrip that is meant to be displayed at 200 frames per second, with each frame of that filmstrip being displayed for 1/200 of a second. In the depicted creation of the filmstrip began at 0 seconds and it takes 1/200 of a second to create each frame. This filmstrip represents the same scene as the filmstrip in FIG. 1 and represents the same period of time.

Frame 2-5 is created at 0.005 seconds.

Frame 2-6 is created at 0.010 seconds.

Frame 2-7 is created at 0.015 seconds.

Frame 2-8 is created at 0.020 seconds.

Frame 2-9 is created at 0.025 seconds.

Frame 2-10 is created at 0.030 seconds.

Frame 2-11 is created at 0.035 seconds.

Frame 2-12 is created at 0.040 seconds.

Total time to display this filmstrip would be 0.04 seconds.

Video may be defined as a series of images or frames displayed in sequence over time in order to give the appearance of motion. Video latency may be defined as the time it takes to render, transmit and display each of these images. Any latency creates a delay which may be a problem for real-time generated video content. Examples of this may include but are not limited to playing video games on a television, flying a remote-controlled airplane equipped with a camera or wearing a virtual reality headset. When playing video games or flying a remote-controlled airplane, latency is a problem because the user is reacting to the images displayed on the screen. Those images are delayed by the total amount of video latency. The higher the latency, the longer it takes for the user to see what is happening and react to real-time events. This problem may be even worse when wearing a virtual reality headset because latency may cause a user to experience headaches and/or nausea as the brain tries to reconcile actual head motion and movement within a virtual reality, to what is being displayed in his/her headset. Reducing this latency may alleviate these problems.

Latency is created at each step in rendering, transmitting, and displaying video. That is to say it takes more than zero time to perform each of these steps for each frame of video. For example, a computer takes a certain amount of time to render a single frame of a video game. It takes a certain amount of time to send that single frame through a cable to a computer monitor. The monitor then takes a certain amount of time to process and display that single frame of video.

Apparatus, systems and methods are herein disclosed to create, transmit and display smaller frames comprising only a portion of the target display, and to show or display these smaller frames more often in order to reduce overall latency.

The present disclosure comprises apparatus, systems and methods of video creation, transmission and display used to reduce latency and enhance video quality in which portions of individual frames of video are created, transmitted and displayed separately and sequentially on a high speed low persistence display.

Instead of rendering, transmitting and displaying entire images x times every second, a method which may be used to render 1/y sized portions of images and transmit and display them x*y times per second. The "y" mentioned above may be described as the variable degree or level to which the method is used. This level therefore may denote how many portions each image is cut into.

Image portions may be sets of rows, columns, individual pixels, patterns (blocks, checkerboard, etc.) depending on performance and desired visual quality.

Rendering may be performed by apparatus, systems and methods on suitable devices or platforms such as, for example, computer, video camera, digital video disc player, video game console, etc. to create each image before it transmits that image to a video display.

Transmission to a video display may be accomplished via a cable or wirelessly. Video may also be on a storage medium, such as a memory card inserted directly into a display, in which case no transmission is needed to get the video to the display. The video creation and video display may also be one in the same, as with a digital video camera equipped with a viewscreen.

Suitable video display devices may include, but are not limited to: televisions, computer monitors, cell phone screens, movie projectors, or virtual reality headsets. High speed displays may be needed for optimal use of this method. High speed displays may be defined as displays capable of refreshing their screens faster than most current common displays, which refresh as slow as 60 times per second.

Image persistence may be defined as how long an image is displayed, usually measured in milliseconds (ms). Ideally, display image persistence should be equal-to or less-than 1/(total number of images displayed per second). However, a high speed display without adequately low persistence may still benefit from the method taught herein.

Using disclosed methods, systems and/or apparatus, entire images of scenes will never actually be displayed. For example, instead of using 60 complete frames or "snapshots" of a scene per second, 120 partial one-half snapshots may be displayed per second (using method level 2, for example). Instead of displaying 1 complete frame for 1/60 of a second, the top half is displayed for 1/120 of a second followed by displaying the bottom half for 1/120 of a second. In an embodiment, at any given point in time, only one half of a complete snapshot of that time is displayed. The other half of that overall snapshot in time may never be rendered, transmitted or displayed. The snapshots of different portions of a scene may never actually be combined because they depict 2 slightly different periods in time. If 2 halves were to be displayed simultaneously, the combined image will not be exactly the same as the corresponding full screen snapshot since the 2 halves depict slightly different times. This is as intended and not a problem since the two halves are not intended to ever be displayed at exactly the same time. These images are merely displayed so rapidly that the human brain will "fill in the gaps" and perceive the entire scene in motion.

In an embodiment, instead of using 60 complete frames or "snapshots" of a scene per second, 240 partial one-quarter snapshots may be displayed per second (using method level 4, for example). At any given point in time, only one quarter of a complete snapshot of that time is displayed. Three quarters of that overall snapshot in time may never be rendered, transmitted or displayed.

A benefit of the apparatus, systems and methods disclosed herein may be reduced latency of image processing, transmission and display times. Disclosed apparatus, systems and methods may reduce latency in each of the rendering, transmitting and displaying parts of the image processing pipeline. In addition to latency, the perceived quality of video may also be improved using this method due to how the brain processes video information. For example, the perception of video "flicker" may be reduced.

High definition 1920×1080 video transmitted at 60 frames per second (FPS) is near the maximum capacity that a High-Definition Multimedia Interface (HDMI) device may accommodate according to currently widely-used HDMI devices and standards. Using the disclosed method at a level of 4, one fourth of a 1920×1080 image (1920×270, for example if row-based portions are used) may be displayed at 4 times the frequency (1920×270 at 240 FPS) with approximately the same processing and transmission bandwidth required. Assuming, for example, it normally takes 40 ms to render, transmit and display each full frame, by instead using the disclosed method at a level of 4, this may reduce the time for each frame by a factor of 4 so that it only takes 10 ms instead of 40 ms.

In an embodiment, a method as herein disclosed may be used with a fast computer capable of generating video images at high speed and a display capable of extremely high refresh rates and extremely low persistence. For example using an OLED display capable of 500 FPS (2 milliseconds refresh rate) with 2 milliseconds persistence, it may be possible to create, transmit and send 100 FPS full screen video over an HDMI cable. Using this same computer, cable and display, it may be possible to use the disclosed method to display an image on ⅕ of the monitor 500 times per second. Row-based portions comprised of every fifth row will likely provide the most perceived uniformity for this example. The primary overall benefit being that latency may be greatly reduced since each frame is only one fifth the size.

For already-existing video material, the disclosed method may be implemented by interpolating additional partial frames of video and only transmitting and displaying those partial frames. For future video material, higher frame rates of that material may be created. An example of this may be a movie camera recording a movie at 240 FPS instead of 60 FPS.

If uneven screen resolution and/or frame rates are considered, other applications of this method may also be possible. For example, using a display with eye-tracking capability, the display may be made to provide higher resolution and/or frame rates in the portion of the screen in which the user is focusing. Images of these variable resolutions and/or frame rates may then be displayed in sequence creating a single video which contains different resolutions and/or frame rates in different areas of the display. Another example may be dynamically increasing frame rates while reducing resolution and/or color depth in a video scene with large amounts of on-screen motion in order to reduce motion blur.

Figure 3:
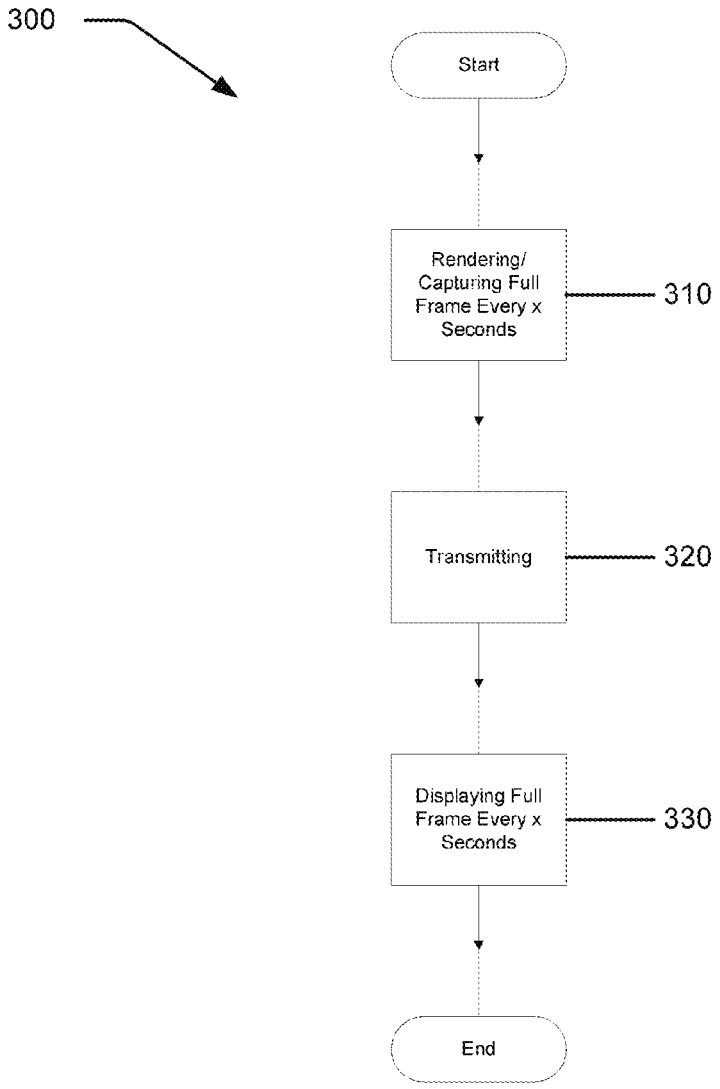
FIG. 3 is a simplified schematic diagram illustrating a method for providing video on a video display in an embodiment of disclosed subject matter.

FIG. 3 depicts an exemplary embodiment of a prior art method according to which most current video is processed and displayed, wherein a video segment is initially rendered/captured in full frame every x seconds, the video is then transmitted in full frame and displayed in full frame on a video display every x seconds. This process is then repeated x times a second in order to produce video.

Figure 4:
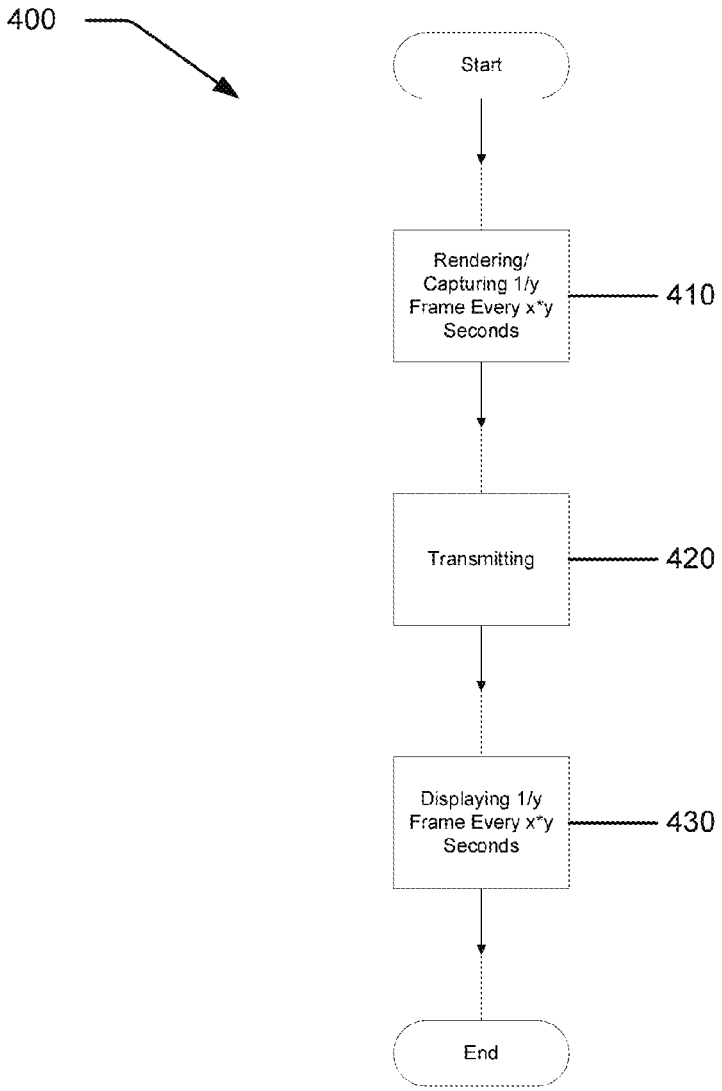
FIG. 4 is a simplified schematic diagram illustrating a method for providing video on a video display in an exemplary embodiment of disclosed subject matter.

FIG. 4 depicts an exemplary embodiment of a method 400 of providing video on a video display, wherein the video, such as a video segment, may be rendered/captured as a partial frame consisting of 1/y of the full frame every x*y seconds, the partial frame is then transmitted and displayed on a video display every x*y seconds in order to have a portion of the video frame updated more frequently than the full frame image may be (as described in FIG. 3).

Figure 5:
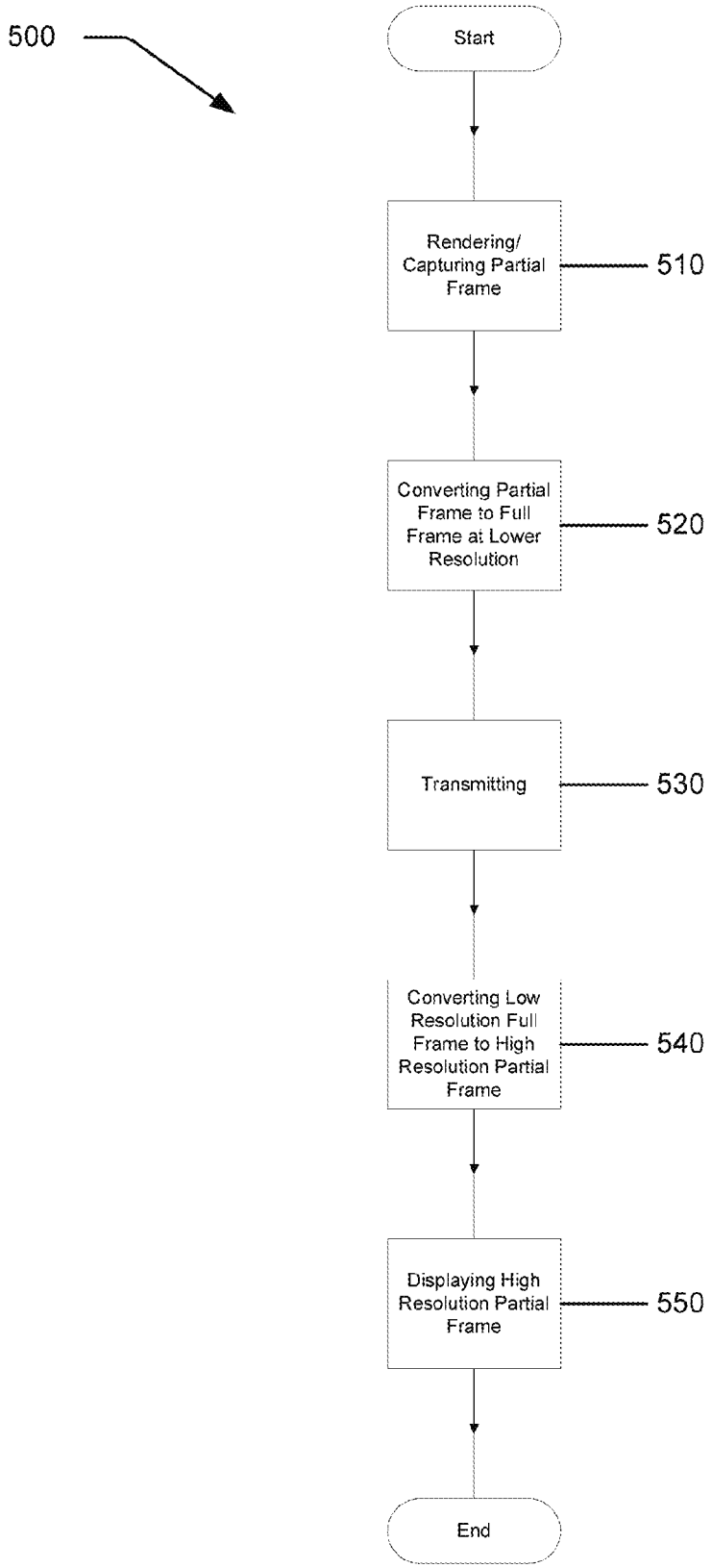
FIG. 5 is a simplified schematic diagram illustrating a method for providing video on a video display in an exemplary embodiment of disclosed subject matter.

FIG. 5 depicts an exemplary embodiment of a disclosed method, wherein the video, such as a video segment, may be initially rendered/captured as a partial frame at a high resolution and converted to a full frame at a smaller resolution prior to being transmitted; whereafter, the video segment is converted back from a full frame at a small resolution to a partial frame at a higher resolution prior to being displayed on the video display.

Figure 6:
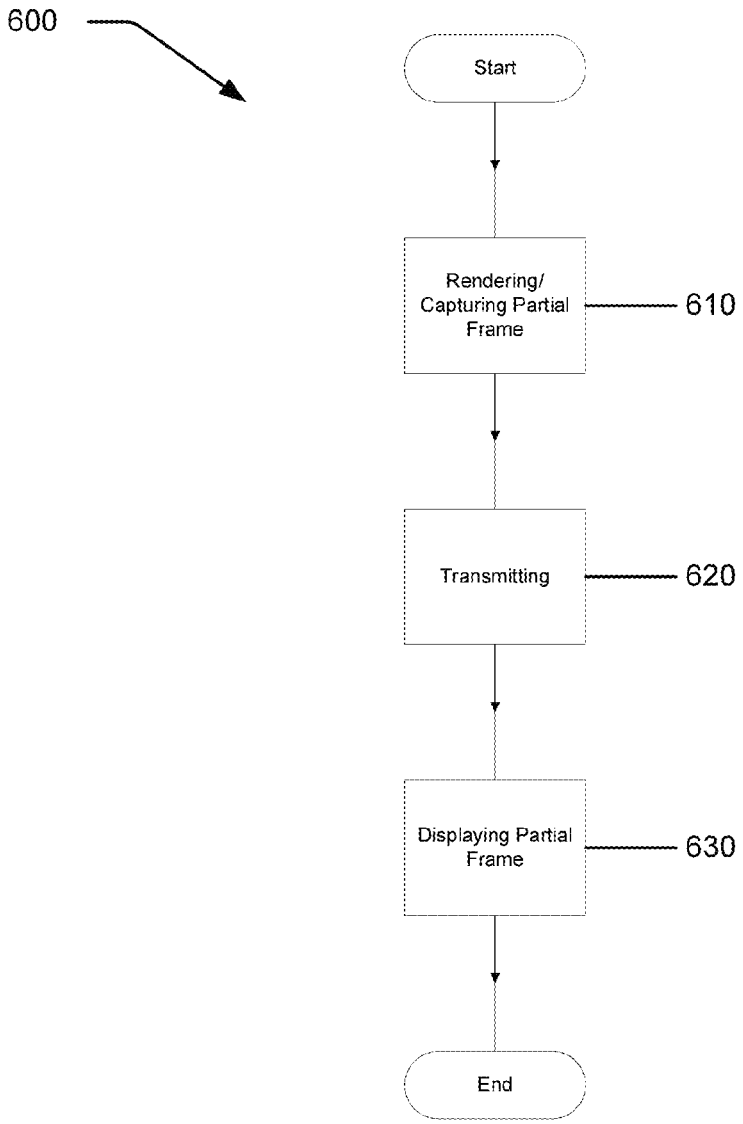
FIG. 6 is a simplified schematic diagram illustrating a method for providing video on a video display in an exemplary embodiment of disclosed subject matter.

FIG. 6 depicts an exemplary embodiment of a disclosed method, wherein video, such as a video segment, is rendered/captured at as a partial frame, the partial frame is transmitted to the video display and displayed as a partial frame.

Figure 7:
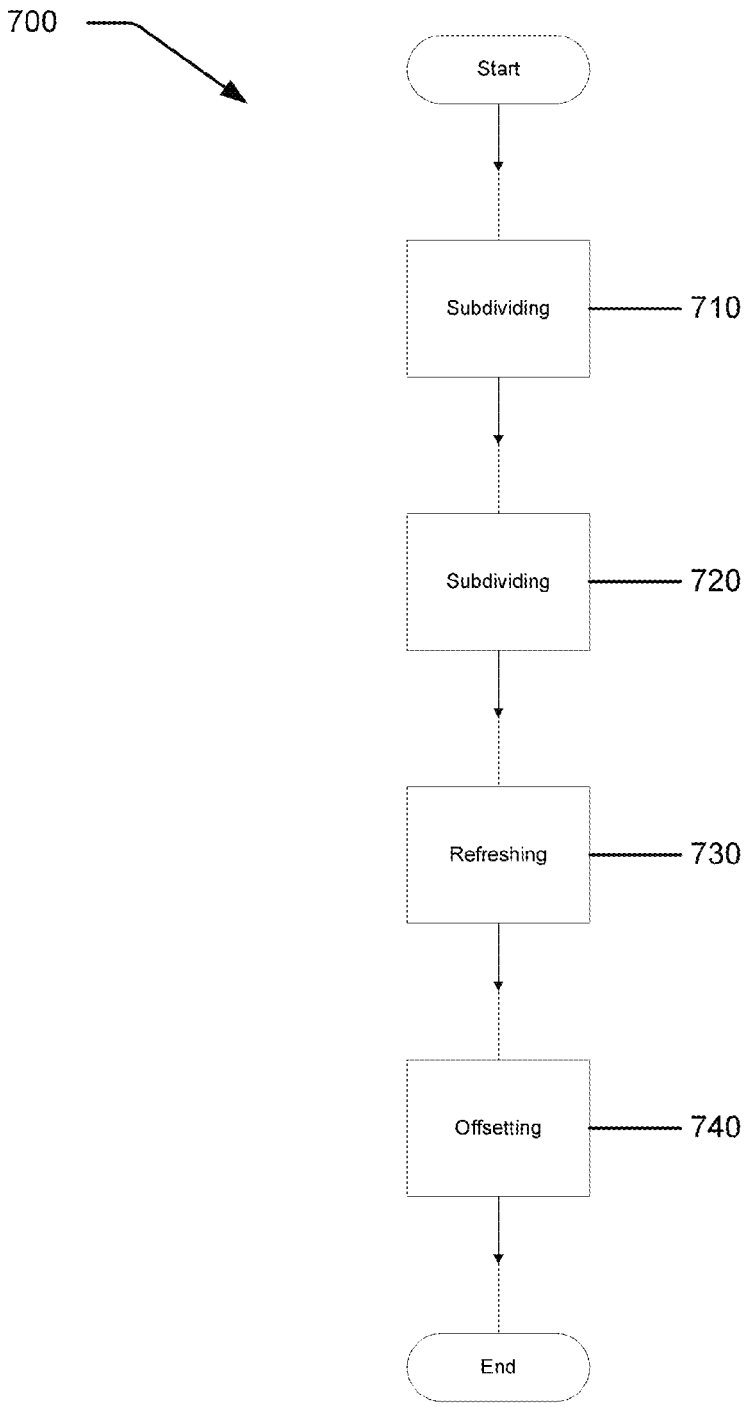
FIG. 7 is a simplified schematic diagram illustrating a method for providing video on a video display in an exemplary embodiment of disclosed subject matter.

FIG. 7 depicts an exemplary embodiment of a manner of implementing a disclosed method, wherein the video, such as a video segment, is initially rendered/captured as a partial frame, transmitted as a partial frame, and then converted from a partial frame to a full frame prior to being displayed on a video display.

Figure 8:
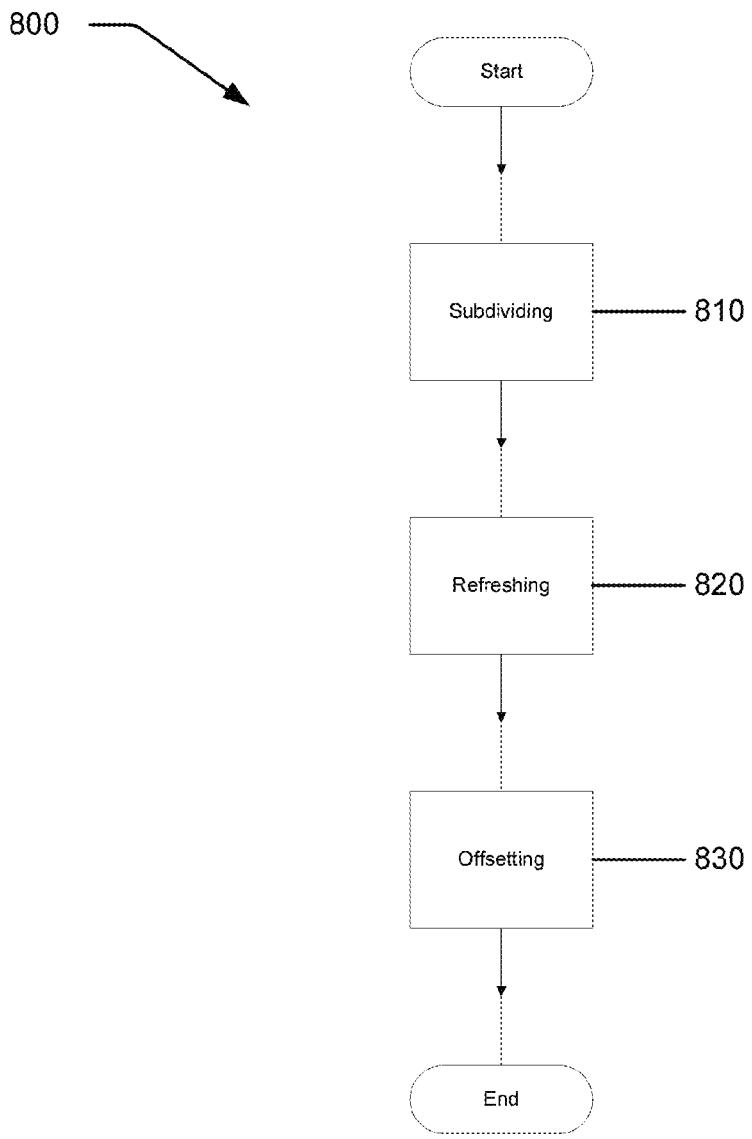
FIG. 8 is a simplified schematic diagram illustrating a method for providing video on a video display in an exemplary embodiment of disclosed subject matter.

FIG. 8 is a simplified schematic diagram illustrating a method 800 for providing video in an exemplary embodiment of disclosed subject matter. Method 800 may provide video on a video display comprised of a plurality of display pixels. Method 800 may include subdividing 810 the video display into a plurality of subgroups of the plurality of display pixels to provide a plurality of partial display pixel subgroups. Method 800 may include refreshing 820 the plurality of partial display pixel subgroups during a video display refresh cycle, other than by refreshing binary sets of alternating lines of single pixels. In the refreshing 820, the video display refresh cycle may include a plurality of partial display pixel subgroup refresh periods corresponding to the plurality of partial display pixel subgroups. Method 800 may include offsetting 830 in time sequence in the video display refresh cycle at least one of the plurality of partial display pixel subgroup refresh periods from others of the plurality of partial display pixel subgroup refresh periods. As used herein, "offsetting" means or includes the refreshing or repeated rendering of different partial display pixel subgroups at different times. In an embodiment, method 800 may further include in the refreshing 820 displaying only partial video frame data. In an embodiment, method 800 may further include in refreshing 820 displaying converted full frames comprising partial video frame data. In an embodiment, method 800 may further include refreshing 820 at least three sets of alternating lines of single pixels each being part of different of the plurality of subgroups.

Figure 9:
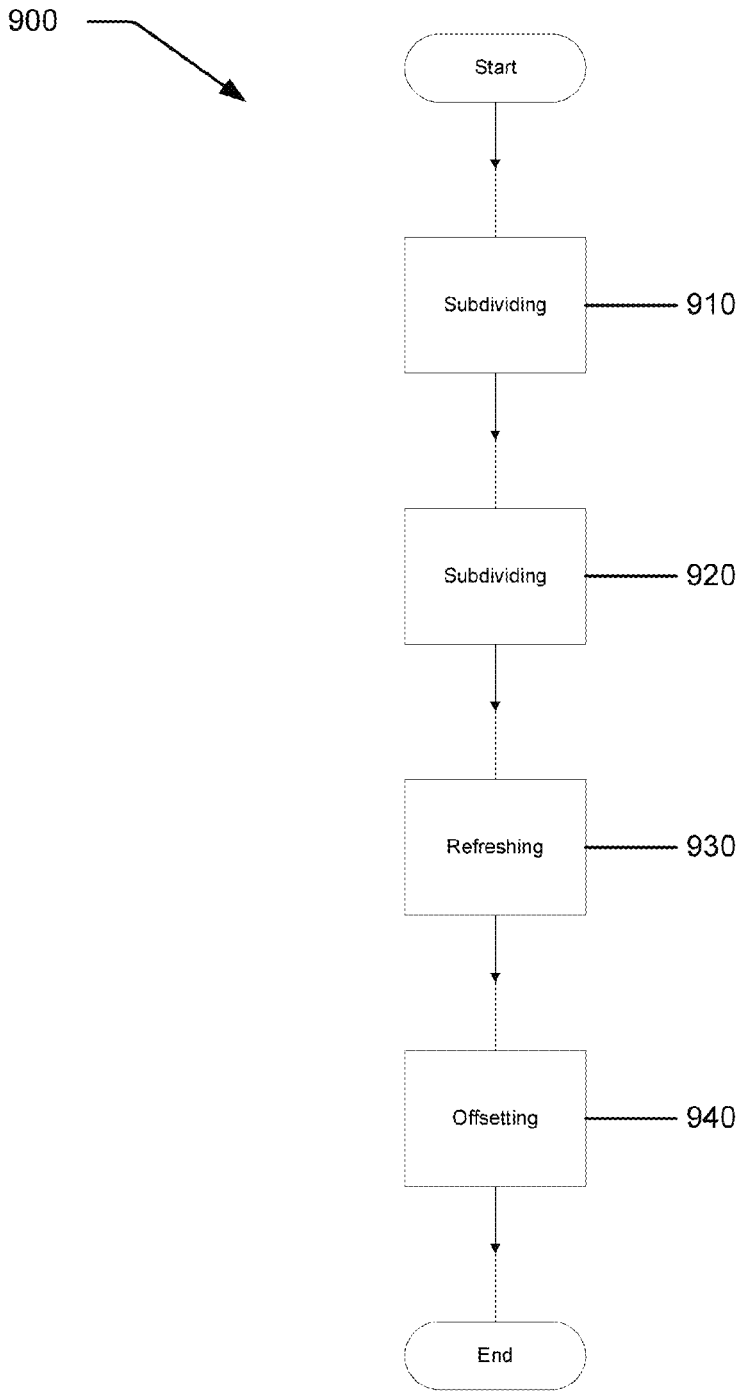
FIG. 9 is a simplified schematic diagram illustrating a method for providing video on a video display in an exemplary embodiment of disclosed subject matter.

FIG. 9 is a simplified schematic diagram illustrating a method 900 for providing video in an exemplary embodiment of disclosed subject matter. Method 900 may provide video on a video display comprised of a plurality of display pixels. Method 900 may include subdividing 910 the video display into a plurality of subgroups of the plurality of display pixels to provide a plurality of partial display pixel subgroups. Method 900 may include subdividing 920 at least one of the plurality of subgroups of the plurality of display pixels to provide a plurality of partial display pixel sub-subgroups. Method 900 may include refreshing 930 the plurality of partial display pixel sub-subgroups during a video display refresh cycle, other than by refreshing alternating lines of single pixels, and wherein the video display refresh cycle includes a plurality of partial display pixel sub-subgroup refresh periods corresponding to the plurality of partial display pixel sub-subgroups. Method 900 may include offsetting 940 in time sequence in the video display refresh cycle at least one of the plurality of partial display pixel sub-subgroup refresh periods from at least one other of the plurality of partial display pixel sub-subgroup refresh periods. In an embodiment, method 900 may further include in the refreshing 930 displaying partial video frame data. In an embodiment, method 900 may further include in the refreshing 930 displaying converted full frames comprising non-compressed partial video frame data. In an embodiment, method 900 may further include refreshing 930 at least three sets of alternating lines of single pixels each being part of different of the plurality of sub-subgroups.

Figure 10:
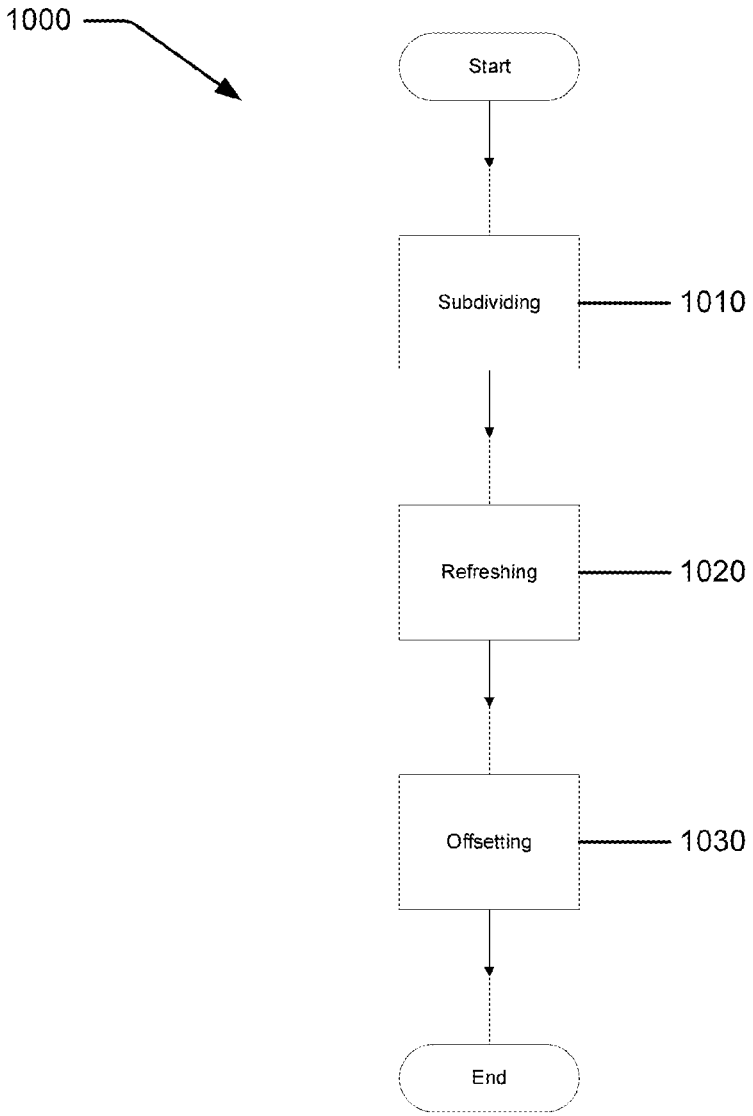
FIG. 10 is a simplified schematic diagram illustrating a method for providing video on a video display in an exemplary embodiment of disclosed subject matter.

FIG. 10 is a simplified schematic diagram illustrating a method 1000 for providing video in an exemplary embodiment of disclosed subject matter. Method 1000 may provide video on a video display comprised of a plurality of display pixels. Method 1000 may include subdividing 1010 the video display into at least three subgroups of the plurality of display pixels to provide at least three partial display pixel subgroups. Method 1000 may include refreshing 1020 the at least three partial display pixel subgroups during a video display refresh cycle, the video display refresh cycle comprising a plurality of partial display pixel subgroup refresh periods corresponding to the at least three partial display pixel subgroups. Method 1000 may include offsetting 1030 in time sequence in the video display refresh cycle at least one of the plurality of partial display pixel subgroup refresh periods from others of the plurality of partial display pixel subgroup refresh periods. In an embodiment, method 1000 may further include in refreshing 1020 the displaying of partial video frame data. In an embodiment, method 1000 may further include in refreshing 1020 the displaying of converted full frames comprising partial video frame data. In an embodiment, method 1000 may further include refreshing 1020 at least three sets of alternating lines of single pixels each being part of different of the at least three subgroups.

Figure 11:
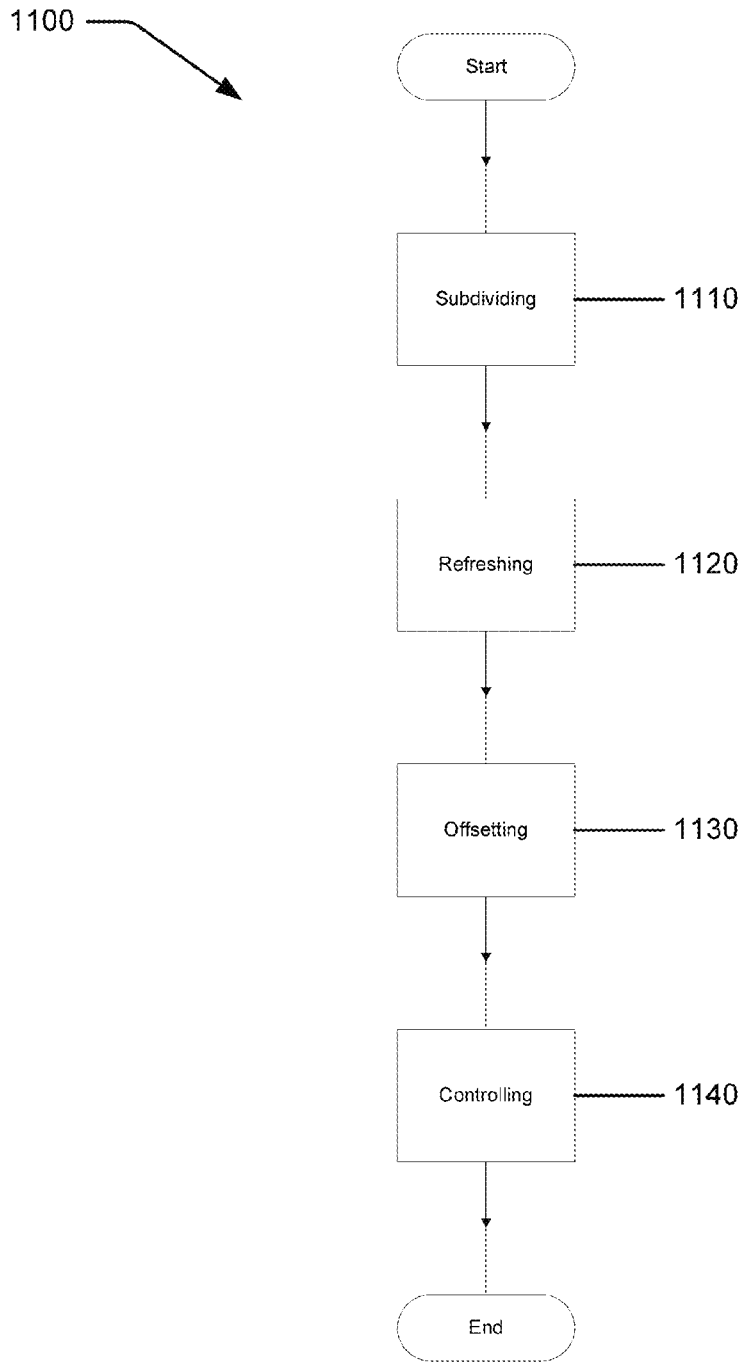
FIG. 11 is a simplified schematic diagram illustrating a method for providing video on a video display in an exemplary embodiment of disclosed subject matter.

FIG. 11 is a simplified schematic diagram illustrating a method 1100 for providing video in an exemplary embodiment of disclosed subject matter. Method 1100 may provide video on a video display comprised of a plurality of display pixels. Method 1100 may include subdividing 1110 the video display into a plurality of subgroups of the plurality of display pixels to provide a plurality of partial display pixel subgroups. Method 1100 may include refreshing 1120 the plurality of partial display pixel subgroups during a video display refresh cycle, wherein the video display refresh cycle includes a plurality of partial display pixel subgroup refresh periods corresponding to the plurality of partial display pixel subgroups. Method 1100 may include offsetting 1130 the plurality of partial display pixel subgroup refresh periods from each other in time sequence in the video display refresh cycle. Method 1100 may include controlling 1140 latency for providing video on the video display by controlling quantity of the plurality of partial display pixel subgroups. In an embodiment method 1100 may further include in the controlling 1140, controlling latency by controlling the refreshing in relation to optical persistence of the video display.

Figure 12:
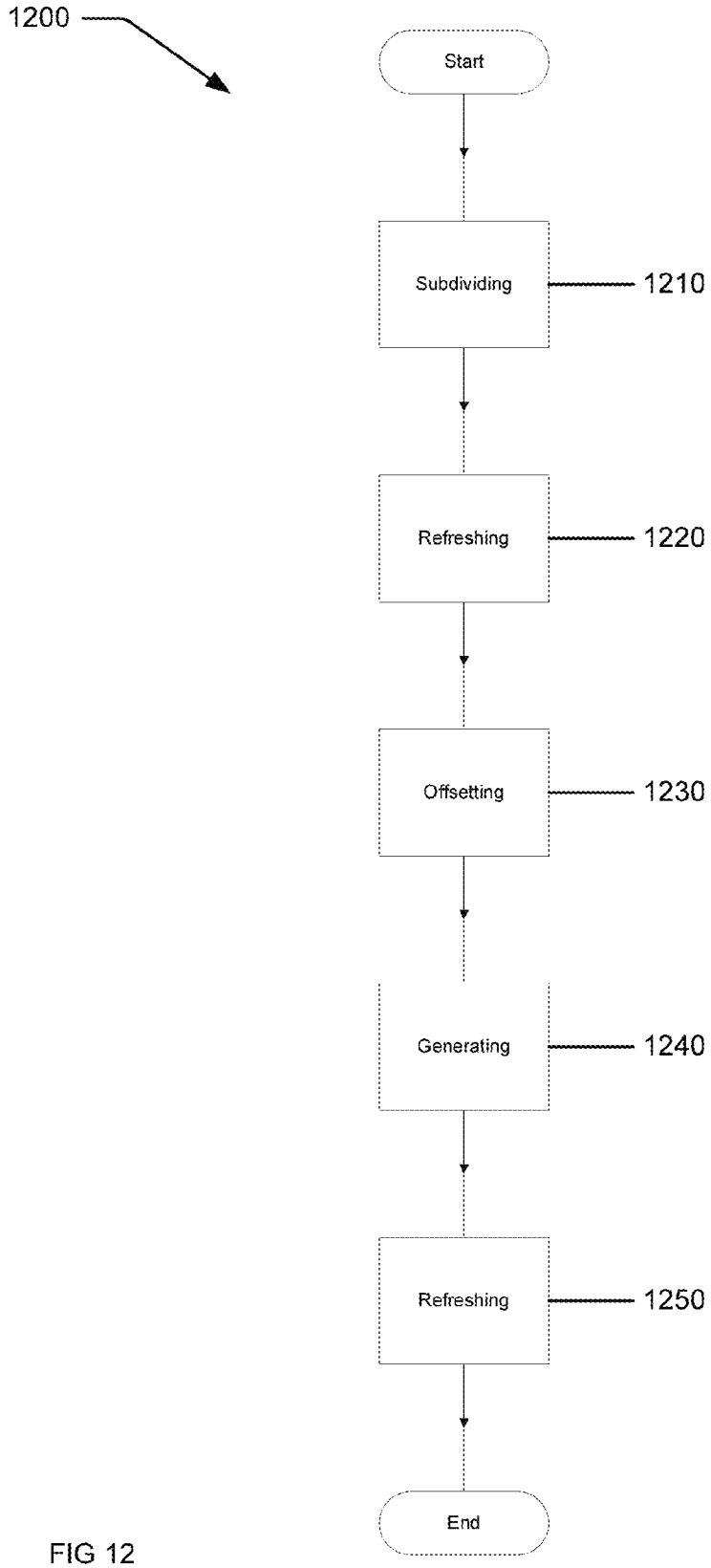
FIG. 12 is a simplified schematic diagram illustrating a method for providing video on a video display in an exemplary embodiment of disclosed subject matter.

FIG. 12 is a simplified schematic diagram illustrating a method 1200 for providing video in an exemplary embodiment of disclosed subject matter. It will be understood that method 1200 may be substantially identical to method 800 as described hereinabove, except as otherwise set forth herein or illustrated in FIG. 12. Method 1200 may provide video on a video display comprised of a plurality of display pixels. Method 1200 may include subdividing 1210 the video display into a plurality of subgroups of the plurality of display pixels to provide a plurality of partial display pixel subgroups. Method 1200 may include refreshing 1220 the plurality of partial display pixel subgroups during a video display refresh cycle, other than by refreshing binary sets of alternating lines of single pixels. In the refreshing 1220, the video display refresh cycle may include a plurality of partial display pixel subgroup refresh periods corresponding to the plurality of partial display pixel subgroups. Method 1200 may include offsetting 1230 in time sequence in the video display refresh cycle at least one of the plurality of partial display pixel subgroup refresh periods from others of the plurality of partial display pixel subgroup refresh periods. In an embodiment, method 1200 may further include in the refreshing 1220 displaying only partial video frame data. In an embodiment, method 1200 may further include in refreshing 1220 displaying converted full frames comprising partial video frame data. In an embodiment, method 1200 may further include refreshing 1220 at least three sets of alternating lines of single pixels each being part of different of the plurality of subgroups. In an embodiment, method 1200 may further include generating 1240 a series of partial video frame data at a processor of a display controller of the video display. In an embodiment, method 1200 may further include in the refreshing 1220, via the display controller refreshing the plurality of partial display pixel subgroups during a full display refresh cycle in relation to the series of partial video frame data. In an embodiment, method 1200 may further include, at a processor of a display controller of the video display, generating 1240 a series of partial video frame data in relation to predetermined pixels of the plurality of partial display pixel subgroups. In an embodiment, method 1200 may further include, via the display controller, refreshing 1250 the plurality of partial display pixel subgroups during a full display refresh cycle to illuminate the predetermined pixels of the plurality of partial display pixel subgroups in relation to the series of partial video frame data.

Figure 13:
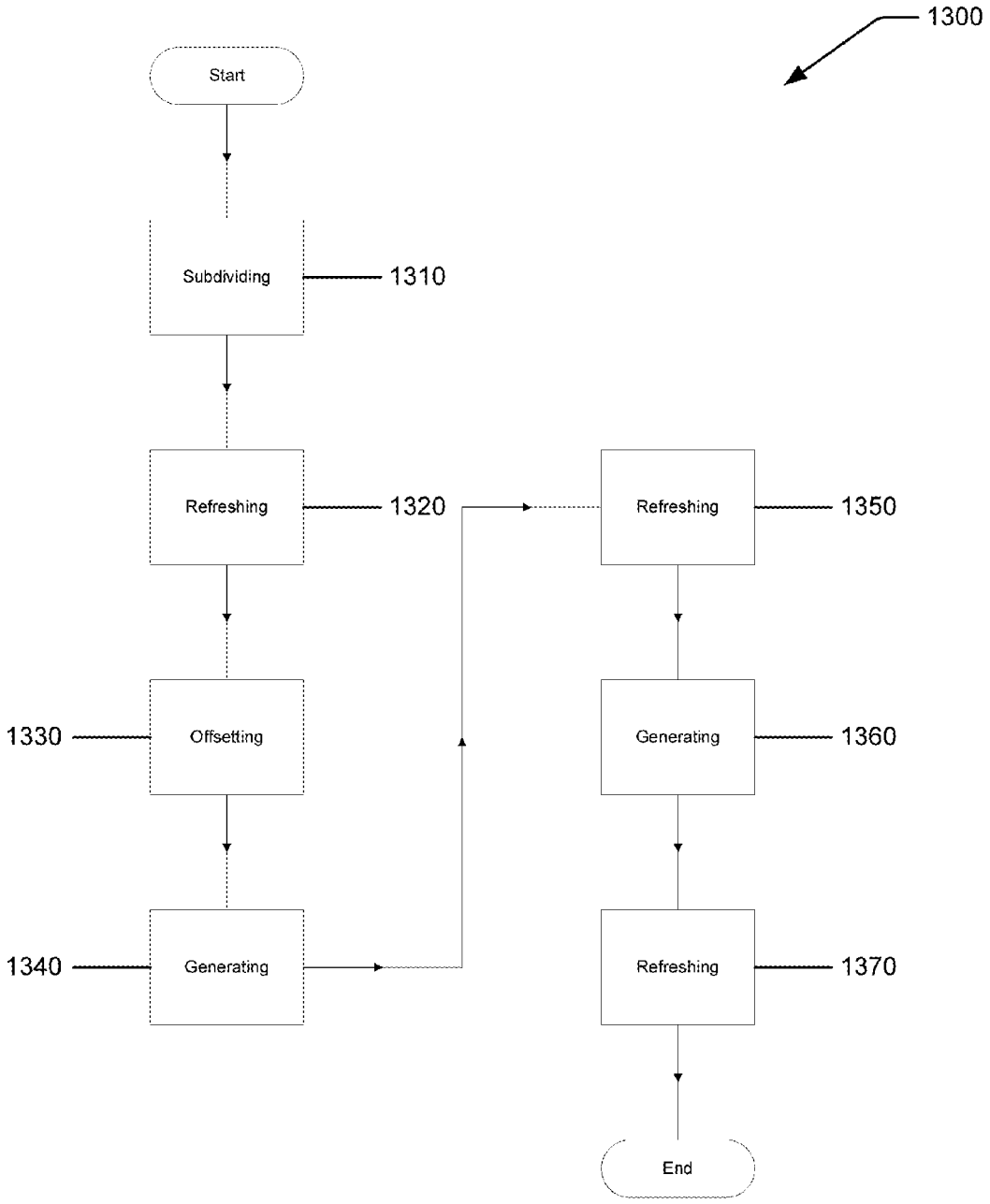
FIG. 13 is a simplified schematic diagram illustrating a method for providing video on a video display in an exemplary embodiment of disclosed subject matter.

FIG. 13 is a simplified schematic diagram illustrating a method 1300 for providing video in an exemplary embodiment of disclosed subject matter. It will be understood that method 1300 may be substantially identical to method 1200 as described hereinabove, except as otherwise set forth herein or illustrated in FIG. 13. In an embodiment, method 1300 may further include, at a processor of a display controller of the video display, generating 1360 a series of partial video frame data in relation to predetermined pixels of the plurality of partial display pixel subgroups. In an embodiment, method 1300 may further include, via the display controller, refreshing 1370 the plurality of partial display pixel subgroups during a full display refresh cycle to illuminate the predetermined pixels of the plurality of partial display pixel subgroups in relation to the series of partial video frame data.

Figure 14:
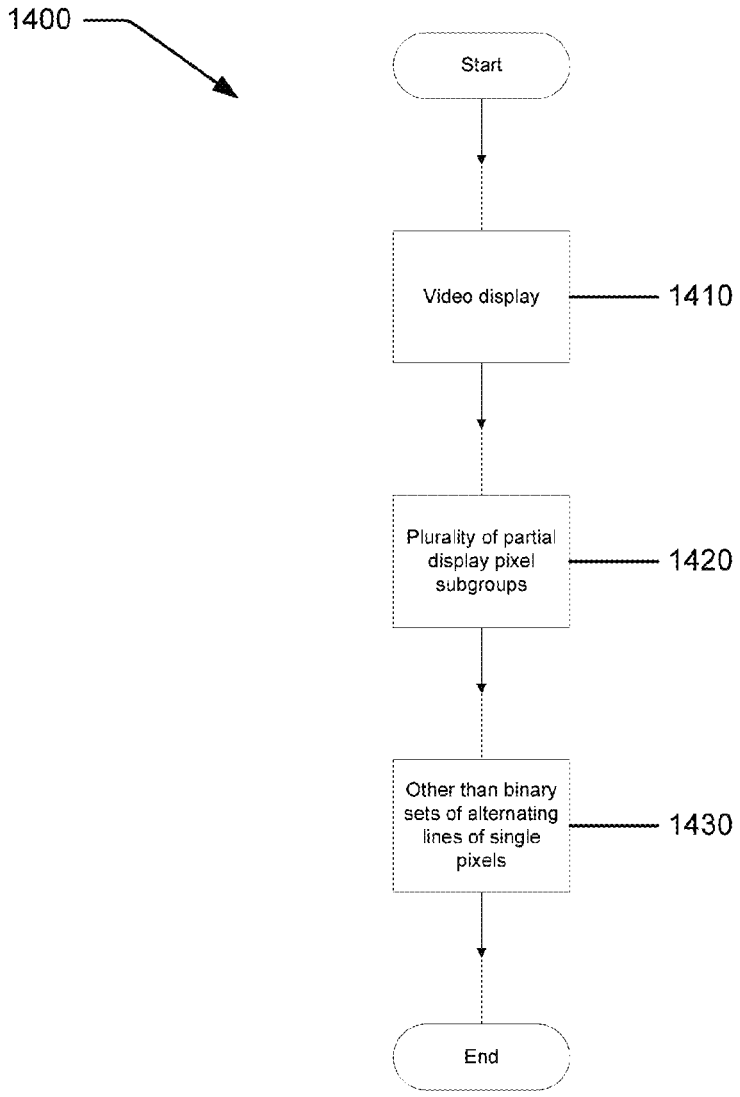
FIG. 14 is a simplified schematic diagram illustrating aspects of a system for providing video on a video display in an exemplary embodiment of disclosed subject matter.

Illustrated in FIG. 14 is an exemplary embodiment of a system 1400 for providing video on a video display 1410 including a plurality of display pixels. Video display 1410 may be subdivided into a plurality of subgroups of the plurality of display pixels to provide a plurality of partial display pixel subgroups 1420. The plurality of partial display pixel subgroups 1420 may be refreshed during a video display refresh cycle. The plurality of partial display pixel subgroups 1420 may include other than binary sets of alternating lines of single pixels 1430. The video display refresh cycle may include a plurality of partial display pixel subgroup refresh periods corresponding to the plurality of partial display pixel subgroups 1420. The video display refresh cycle may include at least one of the plurality of partial display pixel subgroup refresh periods being offset in time sequence from others of the plurality of partial display pixel subgroup refresh periods.

Figure 15:
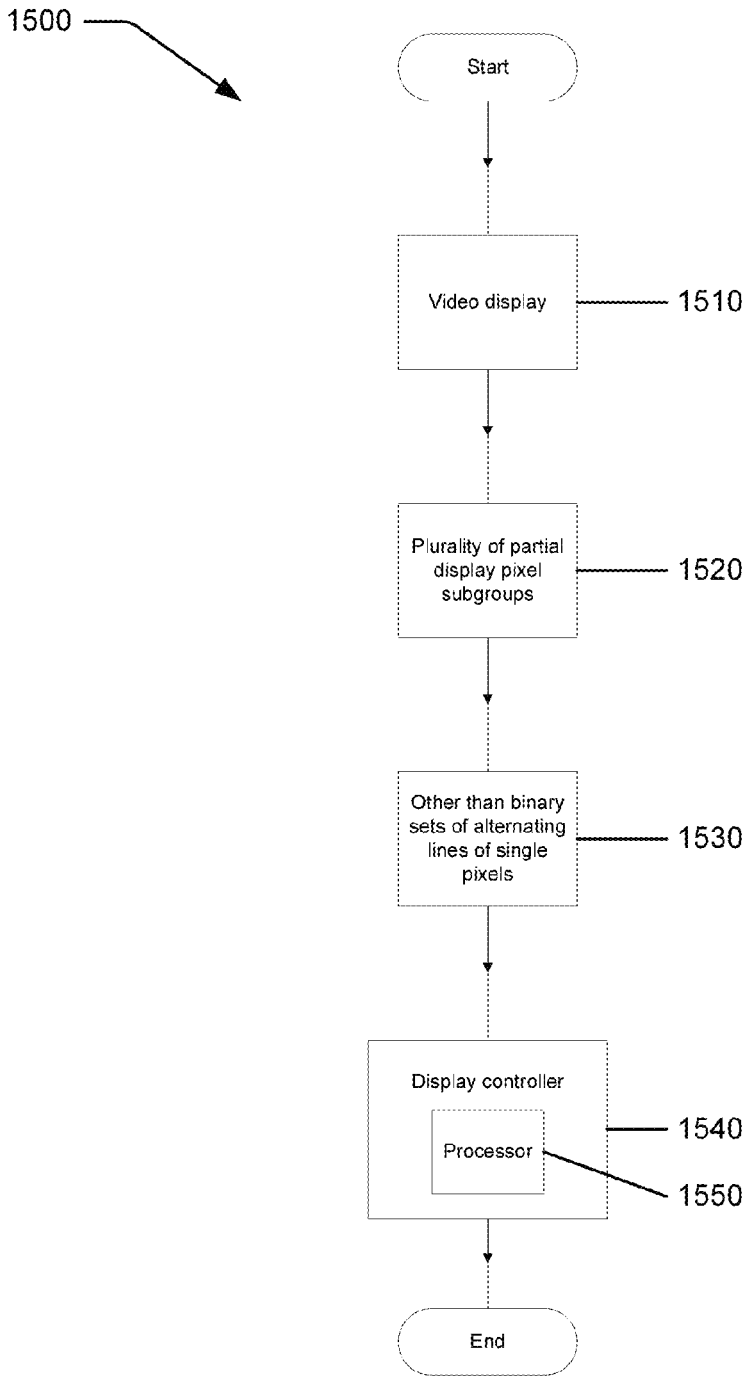
FIG. 15 is a simplified schematic diagram illustrating aspects of a system for providing video on a video display in an exemplary embodiment of disclosed subject matter.

Illustrated in FIG. 15 is a system 1500 for providing video on a video display 1510 including a plurality of display pixels. Video display 1510 may be subdivided into a plurality of subgroups of the plurality of display pixels to provide a plurality of partial display pixel subgroups 1520. The plurality of partial display pixel subgroups 1520 may be refreshed during a video display refresh cycle. The plurality of partial display pixel subgroups 1520 may include other than binary sets of alternating lines of single pixels 1530. The video display refresh cycle may include a plurality of partial display pixel subgroup refresh periods corresponding to the plurality of partial display pixel subgroups 1520. The video display refresh cycle may include at least one of the plurality of partial display pixel subgroup refresh periods being offset in time sequence from others of the plurality of partial display pixel subgroup refresh periods. In an embodiment, system 1500 may further include a display controller 1540 having a processor 1550 operable for generating a series of partial video frame data. In an embodiment, system 1500 may further include the display controller 1540 being operable for refreshing the plurality of partial display pixel subgroups 1520 during a full display refresh cycle to illuminate the plurality of partial display pixel subgroups 1520 in relation to the series of partial video frame data. It will be understood that in an embodiment, system 1500 may further include a display controller 1540 having a processor 1550 operable for generating a series of partial video frame data in relation to predetermined pixels of the plurality of partial display pixel subgroups 1520, wherein the display controller 1540 is operable for refreshing the plurality of partial display pixel subgroups during a full display refresh cycle in relation to the series of partial video frame data. It will be understood that in an embodiment, system 1500 may further include the plurality of partial display pixel subgroups 1520 being refreshed by displaying converted full frames comprising partial video frame data. It will be understood that in an embodiment, system 1500 may further include the plurality of partial display pixel subgroups 1520 being refreshed in at least three sets of alternating lines of single pixels each being part of different of the plurality of partial display pixel subgroups 1520.

The use of any and all examples, or exemplary language (e.g., "such as"), is intended merely to better illustrate the disclosure and does not pose a limitation on the scope of the disclosure unless otherwise claimed. No language in the specification should be construed as indicating any non-claimed element as essential to the practice of the disclosure as used herein.

What is claimed is:

1. A method for providing video on a video display comprised of a plurality of display pixels, said method comprising:

subdividing the video display into a plurality of subgroups of the plurality of display pixels to provide a plurality of partial display pixel subgroups;

refreshing the plurality of partial display pixel subgroups during a video display refresh cycle, the refreshing being other than by refreshing binary sets of alternating lines of single pixels, the video display refresh cycle comprising a plurality of partial display pixel subgroup refresh periods corresponding to the plurality of partial display pixel subgroups; and offsetting in time sequence in the video display refresh cycle at least one of the plurality of partial display pixel subgroup refresh periods from others of the plurality of partial display pixel subgroup refresh periods;

wherein refreshing comprises displaying converted full frames comprising non-compressed partial video frame data.

2. A method according to claim 1 and further comprising:

wherein refreshing comprises refreshing at least three sets of alternating lines of single pixels each being part of different of the plurality of subgroups.

3. A method according to claim 1 and further comprising:

at a processor of a display controller of the video display:

generating a series of partial video frame data, via the display controller:

refreshing the plurality of partial display pixel subgroups during a full display refresh cycle in relation to the series of partial video frame data.

4. A method according to claim 3 and further comprising:

at a processor of a display controller of the video display:

generating a series of partial video frame data in relation to predetermined pixels of the plurality of partial display pixel subgroups, via the display controller:

refreshing the plurality of partial display pixel subgroups during a full display refresh cycle to illuminate the predetermined pixels of the plurality of partial display pixel subgroups in relation to the series of partial video frame data.

5. A method for providing video on a video display comprised of a plurality of display pixels, said method comprising:

subdividing the video display into a plurality of subgroups of the plurality of display pixels to provide a plurality of partial display pixel subgroups;

subdividing at least one of the plurality of subgroups of the plurality of display pixels to provide a plurality of partial display pixel sub-subgroups;

refreshing the plurality of partial display pixel sub-subgroups during a video display refresh cycle, the refreshing being other than by refreshing alternating lines of single pixels, the video display refresh cycle comprising a plurality of partial display pixel sub-subgroup refresh periods corresponding to the plurality of partial display pixel sub-subgroups; and offsetting in time sequence in the video display refresh cycle at least one of the plurality of partial display pixel sub-subgroup refresh periods from at least one other of the plurality of partial display pixel sub-subgroup refresh periods;

wherein refreshing comprises displaying converted full frames comprising non-compressed partial video frame data.

6. A method according to claim 5 and further comprising:

wherein refreshing comprises refreshing at least three sets of alternating lines of single pixels each being part of different of the plurality of sub-subgroups.

7. A method for providing video on a video display comprised of a plurality of display pixels, said method comprising:

subdividing the video display into at least three subgroups of the plurality of display pixels to provide at least three partial display pixel subgroups;

refreshing the at least three partial display pixel subgroups during a video display refresh cycle, the video display refresh cycle comprising a plurality of partial display pixel subgroup refresh periods corresponding to the at least three partial display pixel subgroups; and offsetting in time sequence in the video display refresh cycle at least one of the plurality of partial display pixel subgroup refresh periods from others of the plurality of partial display pixel subgroup refresh periods;

wherein refreshing comprises displaying converted full frames comprising non-compressed partial video frame data.

8. A method according to claim 7 and further comprising:

wherein refreshing comprises refreshing at least three sets of alternating lines of single pixels each being part of different of the at least three subgroups.

9. A method for providing video on a video display comprising a plurality of display pixels, said method comprising:

subdividing the video display into a plurality of subgroups of the plurality of display pixels to provide a plurality of partial display pixel subgroups;

refreshing the plurality of partial display pixel subgroups during a video display refresh cycle, the video display refresh cycle comprising a plurality of partial display pixel subgroup refresh periods corresponding to the plurality of partial display pixel subgroups;

offsetting the plurality of partial display pixel subgroup refresh periods from each other in time sequence in the video display refresh cycle; and controlling latency for providing video on the video display by controlling quantity of the plurality of partial display pixel subgroups;

wherein refreshing comprises displaying converted full frames comprising non-compressed partial video frame data.

10. A method according to claim 9 and further comprising:

wherein the controlling latency further comprises controlling the refreshing in relation to optical persistence of the video display.

11. A system for providing video on a video display comprised of a plurality of display pixels, said system comprising:

the video display being subdivided into a plurality of subgroups of the plurality of display pixels to provide a plurality of partial display pixel subgroups;

the plurality of partial display pixel subgroups refreshed during a video display refresh cycle, the plurality of partial display pixel subgroups comprising other than binary sets of alternating lines of single pixels, the video display refresh cycle comprising a plurality of partial display pixel subgroup refresh periods corresponding to the plurality of partial display pixel subgroups; and the video display refresh cycle comprising at least one of the plurality of partial display pixel subgroup refresh periods offset in time sequence from others of the plurality of partial display pixel subgroup refresh periods;

wherein refreshing comprises displaying converted full-frames comprising non-compressed partial video frame data.

12. A system according to claim 11 and further comprising:

a processor of a display controller of the video display operable for generating a series of partial video frame data, the display controller operable for refreshing the plurality of partial display pixel subgroups during a full display refresh cycle to illuminate the plurality of partial display pixel subgroups in relation to the series of partial video frame data.

13. A system according to claim 12 and further comprising:

a processor of the display controller operable for generating a series of partial video frame data in relation to predetermined pixels of the plurality of partial display pixel subgroups, the display controller operable for refreshing the plurality of partial display pixel subgroups during a full display refresh cycle in relation to the series of partial video frame data.

14. A system according to claim 11 and further comprising:

wherein the plurality of partial display pixel subgroups are refreshed by refreshing at least three sets of alternating lines of single pixels each being part of different of the plurality partial display pixel of subgroups.

* * * * *